US010286653B2

(12) United States Patent
Martin et al.

(10) Patent No.: US 10,286,653 B2
(45) Date of Patent: May 14, 2019

(54) PRINTHEAD

(71) Applicant: HEWLETT-PACKARD DEVELOPMENT COMPANY, L.P., Houston, TX (US)

(72) Inventors: Eric T Martin, Corvallis, OR (US); Chris Bakker, Corvallis, OR (US); James R Przybyla, Philomath, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/526,921

(22) PCT Filed: Dec. 2, 2014

(86) PCT No.: PCT/US2014/068079
§ 371 (c)(1),
(2) Date: May 15, 2017

(87) PCT Pub. No.: WO2016/089372
PCT Pub. Date: Jun. 9, 2016

(65) Prior Publication Data
US 2017/0320320 A1 Nov. 9, 2017

(51) Int. Cl.
*B41J 2/045* (2006.01)
*B41J 2/07* (2006.01)

(52) U.S. Cl.
CPC ..... *B41J 2/04541* (2013.01); *B41J 2/0455* (2013.01); *B41J 2/0458* (2013.01); *B41J 2/04548* (2013.01); *B41J 2/07* (2013.01); *B41J 2202/13* (2013.01)

(58) Field of Classification Search
CPC .. B41J 2/04541; B41J 2/0455; B41J 2/04548; B41J 2/07; B41J 2202/13; B41J 2/0458
See application file for complete search history.

(56) References Cited

U.S. PATENT DOCUMENTS 6,290,334 B1 9/2001 Ishinaga
7,195,341 B2 3/2007 King et al.
(Continued)

FOREIGN PATENT DOCUMENTS

CN 1775528 5/2006
CN 1890102 1/2007
(Continued)

OTHER PUBLICATIONS

Jian-Chiun Liou, et al. Jun. 2011. Multi-dimensional Data Registration CMOS/Mems Integrated Inkjet Printhead.
(Continued)

*Primary Examiner* — Yaovi M Ameh
(74) *Attorney, Agent, or Firm* — HP Inc. Patent Department

(57) ABSTRACT

Printheads and techniques for manufacturing printheads are disclosed. An example method includes forming drive circuit components in a circuit layer. The method also includes forming a fluidic device that causes fluid to be ejected from a nozzle. The method also includes forming an interconnect layer that couples the drive circuit components.

19 Claims, 7 Drawing Sheets

(56) References Cited

U.S. PATENT DOCUMENTS

| | | | | |
|---|---|---|---|---|
| 7,637,584 | B2 * | 12/2009 | Takata | B41J 2/04505 347/11 |
| 8,485,623 | B2 | 7/2013 | McAvoy et al. | |
| 2005/0104928 | A1 | 5/2005 | Edelen et al. | |
| 2006/0066681 | A1 * | 3/2006 | King | B41J 2/04541 347/63 |
| 2006/0262156 | A1 | 11/2006 | Liao et al. | |
| 2012/0182340 | A1 * | 7/2012 | Yokoyama | B41J 2/0452 347/10 |
| 2014/0232791 | A1 | 8/2014 | Gardner et al. | |

FOREIGN PATENT DOCUMENTS

| | | |
|---|---|---|
| CN | 1941446 | 4/2007 |
| CN | 101228032 | 7/2008 |
| EP | 0816082 | 5/2005 |
| JP | H0531898 | 2/1993 |
| JP | 2004090637 | 3/2004 |
| JP | 2005039178 | 2/2005 |

OTHER PUBLICATIONS

Constantine, et al. Micro-Jet Nozzle Array for Precise Droplet Metering and Steering Having Increased Droplet Deflection.

Liou, et al.Jan. 1, 2004. The Performance of High-frequency and Picoliter-droplet Inkjet Printhead by a Standard CMOS Processes.

* cited by examiner

500

600

700

PRINTHEAD

BACKGROUND

Today's printers generally use a fluid delivery system that includes some form of printhead. The printhead holds a reservoir of fluid, such as ink, along with circuitry that enables the fluid to be ejected onto a print medium through nozzles. Some printheads are configured to be easily refilled, while others are intended for disposal after a single-use. The printhead usually is inserted into a carriage of a printer such that electrical contacts on the printhead couple to electrical outputs from the printer. Electrical control signals from the printer activate the nozzles to eject fluid and control which nozzles are activated and the timing of the activation. A substantial amount of circuitry may be included in the printhead to enable control signals from the printer to be properly processed.

BRIEF DESCRIPTION OF THE DRAWINGS

Certain examples are described in the following detailed description and in reference to the drawings, in which.

DETAILED DESCRIPTION OF SPECIFIC EXAMPLES

This disclosure describes techniques for manufacturing printheads with configurable nozzle densities. As mentioned above, printheads often include substantial amounts of circuitry used to drive the activation of nozzles. The drive circuitry can include a circuit layer and an interconnect layer. The circuit layer includes a number of drive circuit components such as logic gates, transistors, resistors, capacitors, and the like, which are fabricated in a semiconductor wafer using semiconductor fabrication techniques. The interconnect layer conductive traces formed over the semiconductor of the circuit layer to couple the drive circuit components. The fluidic layers, which include the fluid chambers and nozzles, are usually fabricated on top of the drive circuitry.

The techniques described herein enable a single drive circuit component layout to be used in the fabrication of printheads with different nozzle densities. This enables the printhead nozzle density to be scaled without modifying the layout of the drive circuit components fabricated in the semiconductor. Additionally, in printheads with reduced nozzle density, the same drive circuit component layout can be used to increase the power used for driving fluid ejection. The drive circuit component layout is re-used with multiple printhead designs by changing the design of the interconnect layer. This allows for one standard circuit layer to be used in the fabrication of different types of printheads with different fluidic layouts, thereby serving a wider product range at lower cost.

Figure 1:
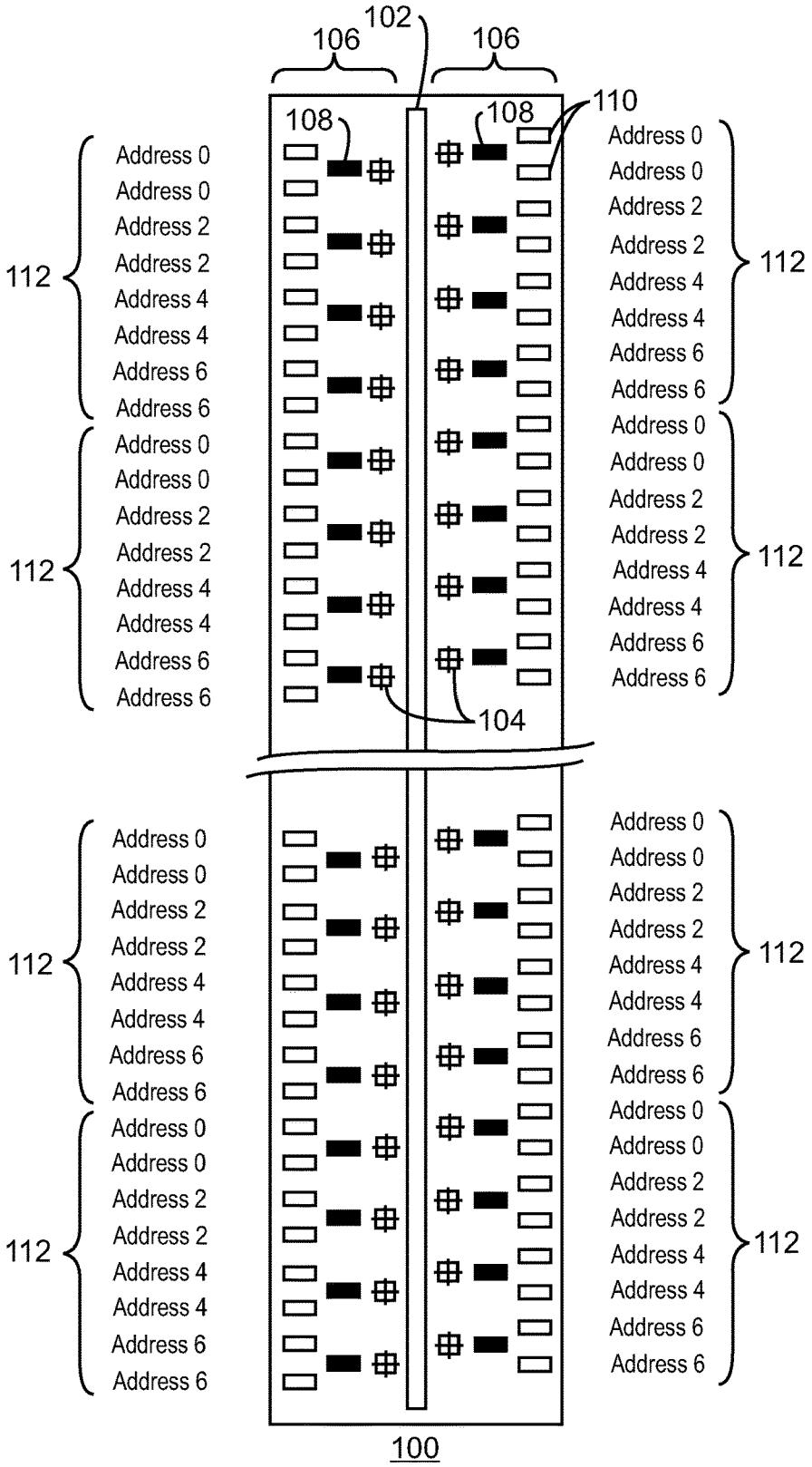
FIG. 1 is a diagram of the bottom surface of an example printhead.

FIG. 1 is a diagram of the bottom surface of an example printhead. The printhead is generally referred to by the reference number 100. The printhead 100 of FIG. 1 includes a fluid feed slot 102 and two columns of nozzles 104, referred to as nozzle columns 106. During use, fluid is drawn from the fluid feed slot 102 and ejected from the nozzles 104 onto a print medium. The fluid may be ink, a material used in three-dimensional printing such as a thermoplastic or photopolymer, or other suitable fluid.

Each nozzle 104 may be part of a fluid chamber that includes an adjacent energy delivery device, which is activated by an activation device. In the present description, the activation devices are referred to herein as transistors 110 and the energy delivery devices are heating elements, which are referred to herein as resistors 108. However, other types of activation devices and energy delivery devices may also be used to activate the nozzles 104. For example, the activation devices may any suitable type of transistors such Field Effect Transistors (FETs), switches such as Micro-Electro-Mechanical System (MEMS) switches, and others. Other examples of energy delivery devices are a piezo electric material that deforms in response to an applied voltage or a paddle made of a multi-layer thinfilm stack that deforms in response to a temperature gradient. Each resistor 108 is electrically coupled to the output of at least one transistor 110, which provides the current to the resistor 108, causing the resistor 108 to generate heat. A selected nozzle 104 can be activated by turning on the corresponding transistors 110, which heats the fluid in contact with or adjacent to the resistor 108 and thereby causes the fluid to be ejected from the nozzle 104. In some examples, the current is delivered to the resistor 108 in a series of pulses. The transistor 110 is part of the drive circuitry of the printhead 100. Other components of the drive circuitry will be described in later figures. The resistors 108, nozzles 104, fluid feed slot 102, and other fluid channeling components are part of the fluidic layer.

The printhead 100 can include any suitable number of nozzles 104. Furthermore, although two nozzle columns 106 are shown, the printhead 100 can include any suitable number of nozzle columns. For example, the printhead 100 can include additional fluid feed slots 102 with corresponding nozzle columns 106 on each side of each fluid feed slot 102. If multiple fluid feed slots 102 are included, each fluid feed slot 102 may be configured to deliver a different type of fluid, such as a different color ink or a different material.

The nozzles 110 may be divided into groups referred to herein as primitives 112. Each primitive 112 can include any suitable number of nozzles 104. In some examples, only 1 nozzle per primitive is fired at any given time. This may be, for example, to manage peak energy demands. To activate specific nozzles 104, the printer sends data to the printhead, which the printhead circuitry processes to determine which nozzles are being targeted. Part of the information received from the printer is address information. Each nozzle 104 within a primitive 112 corresponds with a different address, which is unique within that primitive 112. The nozzle addresses are repeated for each primitive 112. In the example printhead 100 of FIG. 1, the first nozzle 104 in the upper left corner of the printhead 100 is controlled by two transistors 110, which are both associated with address zero. In this example, addressing of firing transistors 110 is configured so that when address 0 is fired, both of the transistors 110 associated with that address will supply energy to the adjacent resistor. This may be beneficial because in such a configuration, higher-energy firing may be achieved. The circuitry for activating the nozzles of the printhead is described further below. Each primitive also includes drive circuitry associated with unused addresses. For example, in the example of FIG. 1, only addresses 0, 2, 4, and 6 are used, while addresses 1, 3, 5, and 7 are unused. The circuit layer includes additional drive circuit components that are associated with the unused addresses and are permanently disabled from activating any nozzle on the printhead. The term "permanently disabled" means the additional, unused circuit components are decoupled and without any adjustable selection feature, such as a switch, that would enable coupling.

Various printhead types can be fabricated using a single drive circuit component layout, which can be standardized to support multiple fluidic layouts. For example, the drive circuit component layout show in FIG. 1 could also be used in a printhead with a doubled nozzle density compared to the nozzle density shown in FIG. 1. To double the nozzle density, additional nozzles 104 and resistors 108 can be added to the fluidic layout between the nozzles 104 and resistors 108 shown in FIG. 1. Each resistor 108 in the double nozzle density printhead would be coupled to a single transistor 110 instead of two as shown in FIG. 1. Thus, the number and position of the transistors 110 and other drive circuit components within the semiconductor of the circuit layer would not change. Similarly, the nozzle density could also be reduced compared to the nozzle density shown in FIG. 1 by removing some nozzles 104 and resistors 108 from the fluidic layout without making any changes to the standard drive circuit component layout fabricated in the semiconductor.

Additionally, the amount electrical power used to drive a particular resistor 108 can be adjusted without any changes to the drive circuit component layout. For example, in some implementations, each resistor 108 can be coupled to the output of two transistors 110. The added current provided by two transistors can cause faster heating and higher-energy fluid ejection compared to a single transistor. In lower energy implementations, each resistor 108 may be coupled to only one transistor 110 and the remaining transistor 110 may be unused. Depending in part on the nozzle density, each resistor 108 can be coupled to one, two, three, four, or more transistors 110.

The printhead 100 also includes an interconnect layer that couples the components of the drive circuitry to one another and couples the drive circuitry to the resistors 108. The interconnect layer can be customized for a particular combination of drive circuit component layout and fluidic layout. For example, a standard drive circuit component layout can be used with multiple nozzle densities by selecting an appropriate interconnect layer that couples the standard circuit layer to the fluidic layer in accordance with the design considerations of a particular implementation. The interconnect layer is described further in relation to FIGS. 3 and 4.

Figure 2:
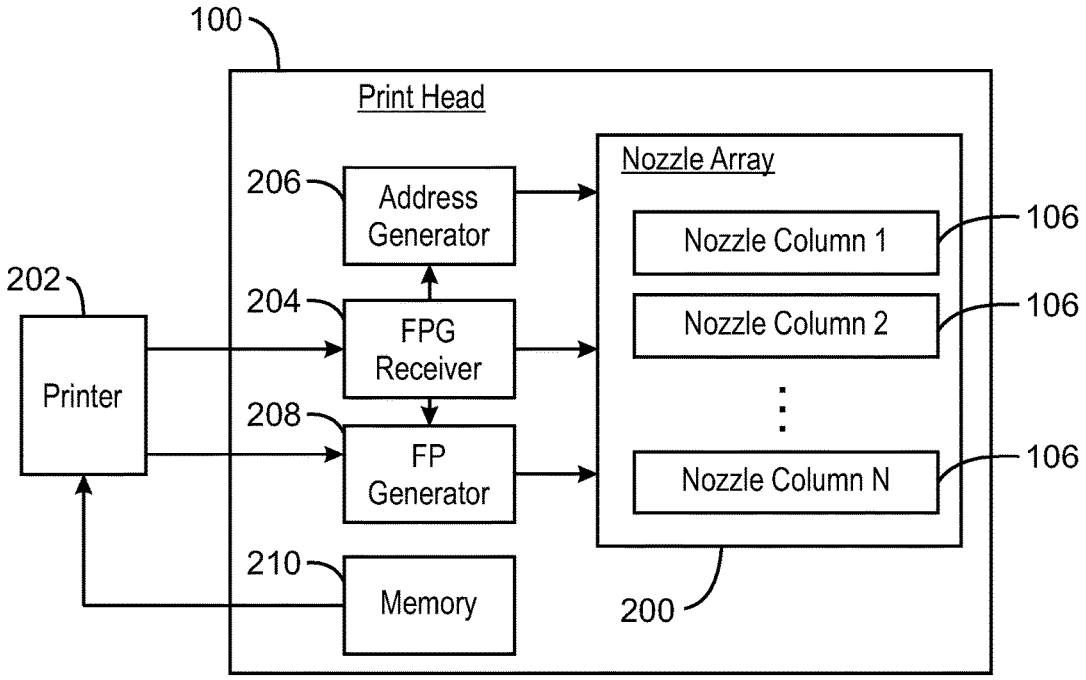
FIG. 2 is a block diagram of an example of drive circuitry that can be used to control the printhead.

FIG. 2 is a block diagram of an example of drive circuitry that can be used to control the printhead. The printhead of FIG. 2 includes N nozzle columns 106, which are shown as part of a nozzle array 200. The printhead may be installed in a printer 202 and configured to receive print commands from the printer through one or more electrical contacts. Print commands may be sent from the printer 202 to the printhead 100 in the form of a data packet referred to herein as a Fire Pulse Group (FPG). The fire pulse group may be received on the printhead by a controller, referred to as the FPG receiver 204. A fire pulse group can include FPG start bits, which are used by the printhead 100 to recognize the start of a fire pulse group, and FPG stop bits, which indicate the end of packet transmission. The fire pulse group can also include a set of address bits for each nozzle column 106. The address supplied to a primitive selects which nozzle within a primitive fires the primitive data, ultimately resulting in fluid ejection. In some examples, the address bits are included in the fire pulse group, and the FPG receiver 204 sends the address bits to the appropriate nozzle columns 200. In some examples, the address bits are not included in the fire pulse group are instead generated on the printhead 100. If the address bits are not included in the fire pulse group, the FPG receiver 204 can send the addressing data to an address generator block 206. The address generator block 206 generates the address bits and sends the address bits to the appropriate nozzle columns 200. In some examples, all primitives within nozzle column 106 use the same address data.

The fire pulse group can also include one or more bits of firing data for each primitive 112 (FIG. 1), referred to herein as primitive data. The primitive data is sent from the FPG receiver 204 to each primitive 112. The primitive data determines whether the nozzle that is identified by the address bits within a particular primitive 112 is activated. The primitive data may be different for each primitive 112.

The fire pulse group can also include pulse data, which controls the characteristics of the current pulses delivered to the resistors 108, such as pulse width, number of pulses, duty cycle, and the like. The fire pulse group can send the pulse data to a firing pulse generator 208, which generates a firing signal based on the pulse data and delivers the firing signal to the nozzle columns 106. Once the fire pulse group has been loaded, the fire pulse generator 208 will send the firing signal to the nozzle columns 106, which causes the addressed nozzles to be activated and eject fluid. A particular nozzle within a primitive will be activated when the primitive data loaded into that primitive indicates firing should occur, the address conveyed to the primitive matches a nozzle address in the primitive, and a fire signal is received by the primitive. The drive circuit that can be used to implement this process is described further in relation to FIGS. 3 and 4.

In some examples, the printhead 100 includes a memory 210 that identifies characteristics of the printhead 100. The memory 210 can be any suitable non-volatile memory and can be programmed by the manufacturer. The memory can include an identifier that identifies the nozzle density or other identifying information about the printhead 100. This information can be read by the printer 202 and used to select a nozzle addressing protocol for activating the correct printhead nozzles. For example, with reference to FIG. 1, the printer 100 can be configured to use only addresses 0, 2, 4, and 6.

It will be appreciated that the block diagram of FIG. 2 is one example of a printhead 100 that can be manufactured in accordance with the techniques described herein and that several variations may be possible within the scope of the claims. For example, one or more components of the printhead 100, such as the address generator 206 and the fire pulse generator 208, may be separate from the printhead 100. Furthermore, the printhead 100 can be used in any suitable type of precision dispensing device, including a two-dimensional printer, three-dimensional printer, and a digital titration device, among others. Examples of two-dimensional printing technology include thermal ink jet (TIJ) technology, and piezoelectric ink jet technology, among others.

Figure 3:
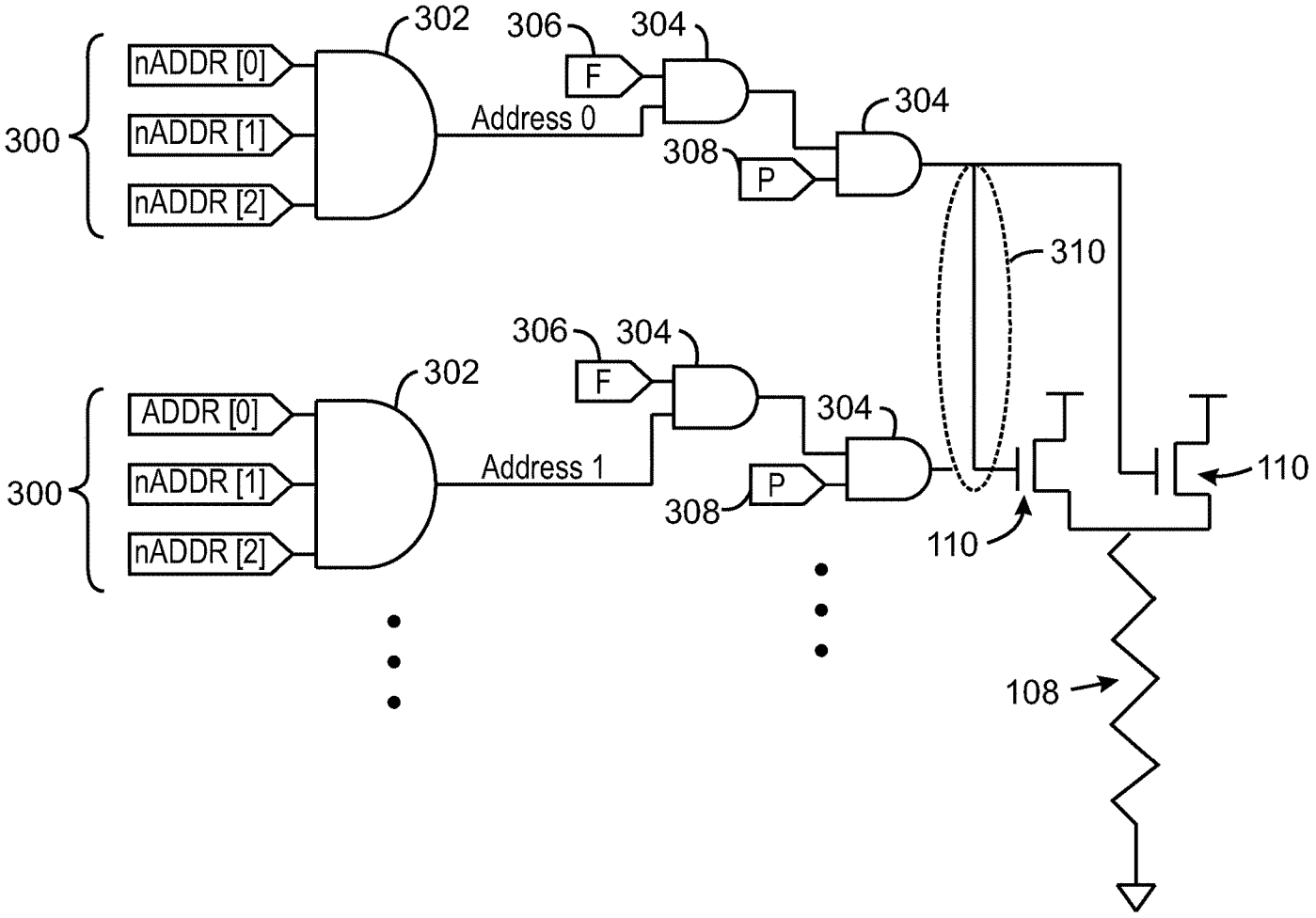
FIG. 3 is a circuit diagram showing a portion of the drive circuit for a printhead.

FIG. 3 is a circuit diagram showing a portion of the drive circuit for the printhead of FIG. 1. The drive circuit includes a circuit layer, which includes two transistors 110 and logic components for controlling the firing of the transistors 110. The output of each transistor 110 is coupled to a single resistor 108, which is used as the heating element for fluid ejection and is associated with a single nozzle 104 (FIG. 1). The resistor 108 is part of the fluidic layer. The resistor 108 and transistors 110 are also shown in FIG. 1. The components shown in FIG. 3 may be repeated for each pair of transistors 110 on the printhead. Furthermore, it will be appreciated that the drive circuit can include additional components not shown in FIG. 3. The circuit layer of FIG. 3 is standardized, meaning that it can be used in combination with several different fluidic layer designs. The placement and number of resistors 108 will vary depending on the nozzle density of the printhead.

In the example drive circuit of FIG. 3, three address bits 300 are received by AND gates 302. Three address bits are used in this example, because there are eight unique nozzle addresses for each primitive. The three address bits 300 are labeled ADDR[0], ADDR[1], and ADDR[2]. An address bit label proceeded by the letter "n" indicates that the address bit has been inverted. Each unique combination of address bits 300 will cause the output of one of the AND gates 302 to output a logic one. The output of each AND gate 302 is referred to as the "address selection signal" and is a single digital logic bit that indicates which one of the nozzles in a primitive is selected for activation. The output of each AND gate 302 is sent to another network of AND gates 304 along with the firing signal 306 and the primitive data 308. The output of each AND gate 304 can be coupled to the gate of one or both transistors 110, depending on the type of nozzle configuration. In the example shown in FIG. 3, the output corresponding to address 0 is output to both of the transistors 110. By comparison, in an implementation with twice as many nozzles 104, one transistor 110 could be coupled to address 0 and the other transistor 110 could be coupled to address 1. Accordingly, it can be seen that the standardized drive circuit component layout of FIG. 3 can be used to support various fluidic layouts (different nozzle densities, for example) without any change in the semiconductor components.

The interconnect layer provides the electrical connections between the semiconductor components and enables the standardized drive circuit component layout to be adapted to a variety of various fluidic layouts. For example, two different nozzle densities can be supported with minor changes in the interconnect layer as indicated by the circle 310, which shows that the output at address 1 is floating, while the output at address 0 is coupled to both transistors 110.

Various other changes can be made to the configuration shown in FIG. 3. For example, the logic components of FIG. 3 are shown as a set of AND gates. However, the logic components may be implemented as any suitable combination of electronic devices, such as AND gates, OR gates, inverters, flip-flops, and diodes, among others. Additionally, various modifications can also be made to the interconnect layer. For example, the output at address 0 could be coupled to one of the transistors 110, and the other transistor 110 could be left uncoupled to any output. Another technique for configuring the drive circuitry is shown in FIG. 4.

Figure 4:
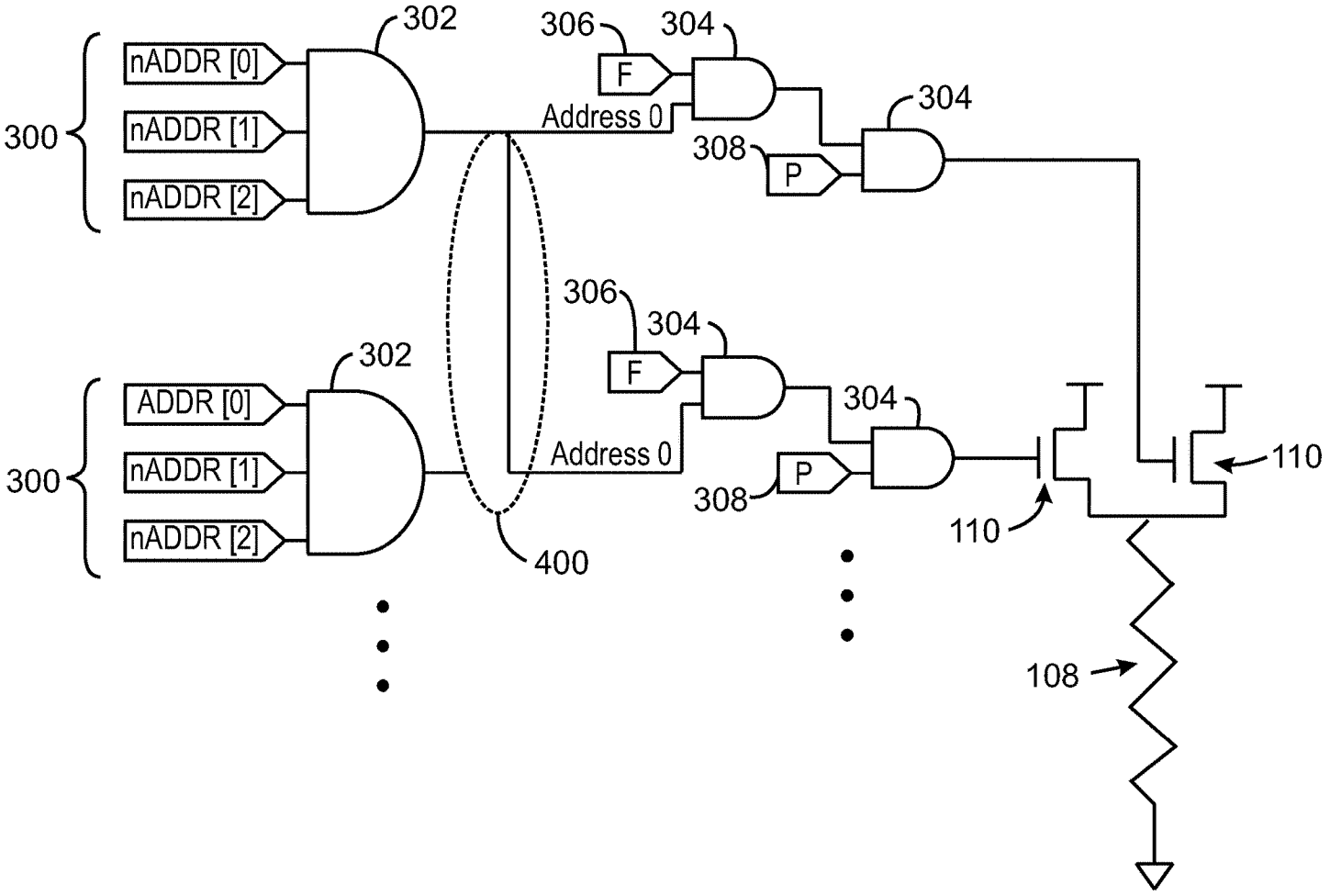
FIG. 4 is a circuit diagram showing another configuration for the drive circuit.

FIG. 4 is a circuit diagram showing another configuration of the drive circuit. The drive circuit of FIG. 4 shows another way of connecting the components of the circuit layer. The circuit layer and fluidic layer of FIG. 4 is the same as FIG. 3. The drive circuitry is configured differently by using a different interconnect layout.

In the example drive circuit of FIG. 4, the output of each of the AND gates 304 is coupled to one of the transistors 110. Thus, unlike the configuration of FIG. 3, each transistor 110 is triggered by a different set of logic components. To associate both transistors 110 with address 0, the output of the AND gate 302 associated with address 0 is coupled to both networks of logic gates 304. This is indicated by the circle 400, which shows that the output at address 1 is floating, while the output at address 0 is coupled to the logic gates 304. By comparison, in an implementation with twice as many nozzles 104, the output of the AND gate 302 associated with address 0 can coupled to one network of logic gates 304, and the output of the AND gate 302 associated with address 1 can be coupled to the other networks of logic gates 304.

Figure 5:
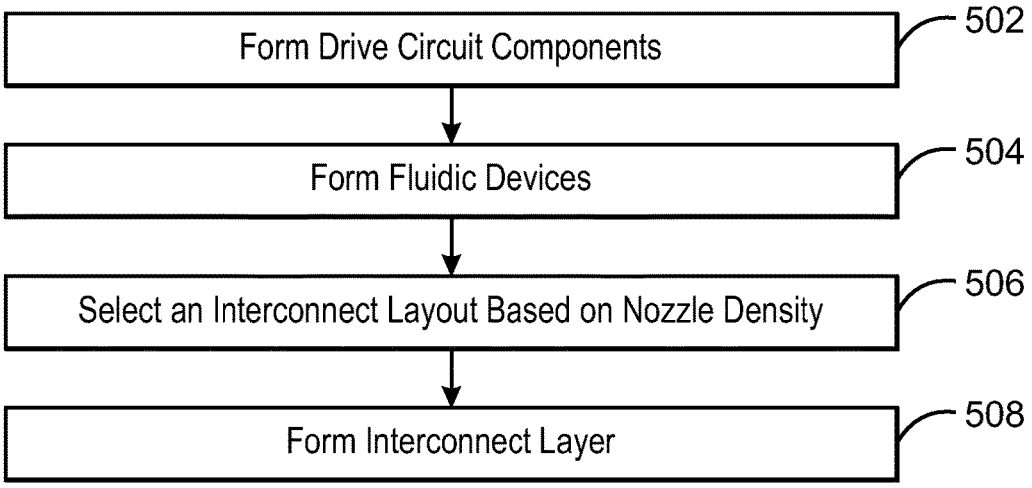
FIG. 5 is a process flow diagram for a method of manufacturing a printhead

FIG. 5 is a process flow diagram for a method of manufacturing a printhead. The method 500 can be performed using known semiconductor and MEMs fabrication techniques, which include material deposition, removal, patterning, electrical property modification, and the like.

At block 502, the drive circuit components of the circuit layer are formed. The drive circuit components may be formed in semiconductor such as silicon. The drive circuit components are the devices that are used to address and activate the energy delivery devices associated with particular nozzles. The layout of the drive circuit components is a standardized layout that is not dependent on a nozzle density of the printhead and can be used in different printhead types with different nozzle densities.

At block 504, the fluidic devices of the fluidic layer are formed. The fluidic layer includes the fluid chamber with the fluid ejection nozzles, fluid feed channels, energy delivery devices, and the like. In some examples, the fluidic layer is formed over the drive circuit components of the circuit layer. In the present description, the term "over" does not mean "directly over." Accordingly, forming the fluidic layer over the drive circuit components means that the fluidic layer can be formed directly over the drive circuit components, or additional intervening layers can be formed over the drive circuit components prior to forming the fluidic layer.

At block 506, an interconnect layer design is selected. The layout of the interconnect layer can be selected depending, at least in part, on the nozzle density of the printhead.

At block 508, the interconnect layer is formed over the drive circuit components of the circuit layer. The interconnect layer configures the drive circuit components by coupling the drive circuit components to one another and coupling the drive circuit components to the appropriate energy delivery devices according to the selected configuration. In a full nozzle density implementation, each available activation device in the circuit layer is paired with a nozzle, and each energy delivery device is coupled to a single activation device that is addressable to activate the nozzle.

In implementations with less than full nozzle density, the forming of the interconnect layer may leave some of the drive circuit components permanently uncoupled from all of the activation devices and unpaired with a corresponding nozzle. For example, in a half nozzle density implementation, each energy delivery device can be coupled to a pair of activation devices that are simultaneously addressable to activate the nozzle. The pair of activation devices may be driven by an output received from a same component of the drive circuitry, as shown in FIG. 3 for example. Each one of the pair of activation devices may also be driven by separate components of the drive circuitry, as shown in FIG. 4 for example. In another implementation of a half nozzle density printhead, each energy delivery device is coupled to a single activation device, and the remaining half of the activation devices is permanently uncoupled.

The process flow diagram of FIG. 5 is not intended to indicate that the operations of the method 500 are to be executed in any particular order, or that all of the operations of the method 500 are to be included in every case. For example, in some implementations, the interconnect layer is formed over the drive circuit components before the fluidic devices are formed over the drive circuit components. Additionally, the method 500 can include any suitable number of additional operations.

Figure 6:
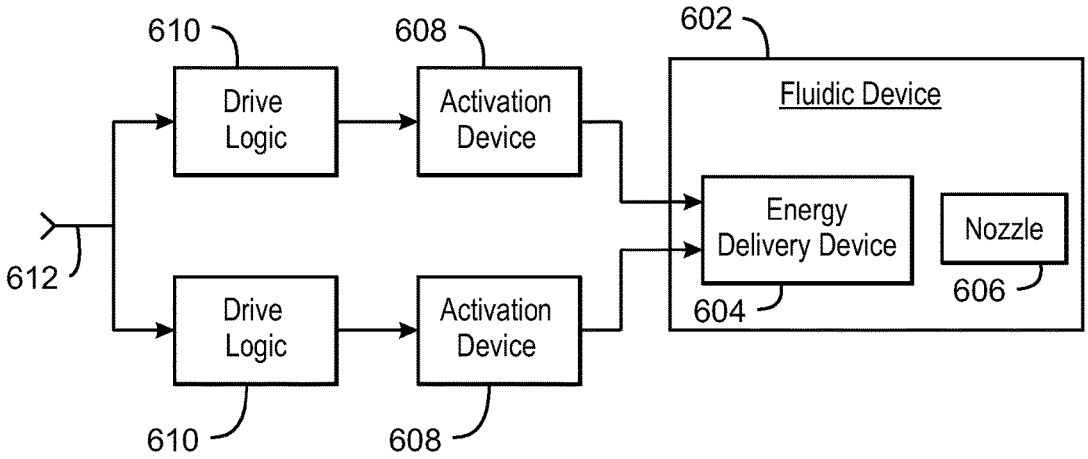
FIG. 6 is a block diagram showing a simplified example of a printhead assembly that includes a standardized drive circuit component layout.

FIG. 6 is a block diagram showing a simplified example of a printhead assembly that includes a standardized drive circuit component layout. The example printhead 600 includes a fluidic device 602 coupled to an energy delivery device 604 that can cause fluid to be ejected from a nozzle 606. For example, the fluidic device 602 may include a fluid chamber, and the energy delivery device 604 may be a heating element such as a resistor. The printhead 600 also includes a circuit layer that includes drive circuit components. The drive circuit components include activation devices 608 to activate the energy delivery device 604 and drive logic 610 to drive the activation devices. For example, each activation device 608 may be a transistor such as a FET, and the drive logic 610 may include a logic gate or a network of logic gates and other circuitry. Each activation device 608 is coupled to separate drive logic 610. The printhead also includes an interconnect layer to electrically couple the drive circuit components. The interconnect layer in the example printhead of FIG. 6 couples the same address selection signal 612 to the drive logic 610 coupled to both activation devices 608.

Figure 7:
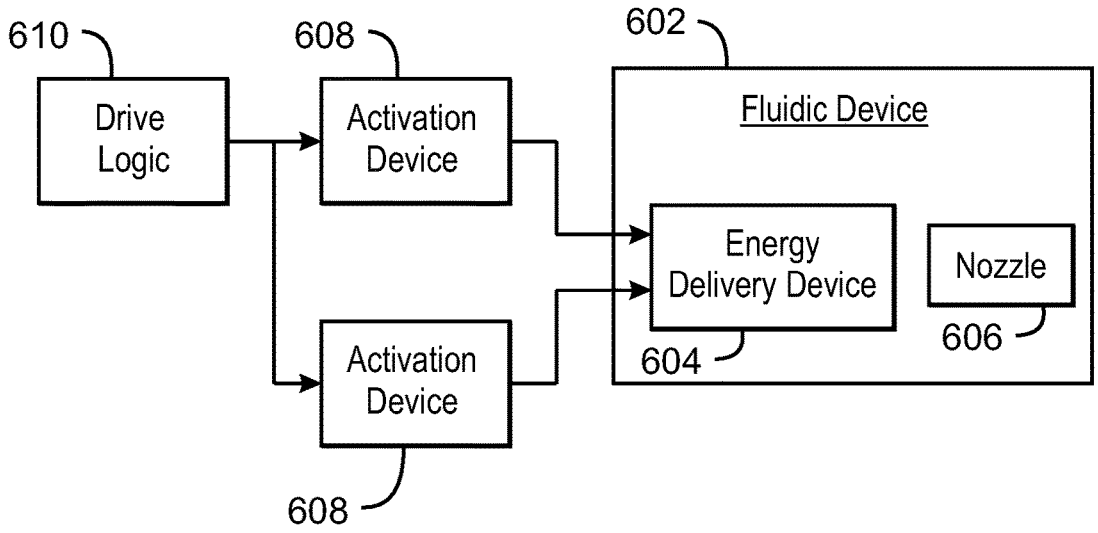
FIG. 7 is a block diagram showing a simplified example of another printhead assembly that includes a standardized drive circuit component layout.

FIG. 7 is a block diagram showing a simplified example of another printhead assembly that includes a standardized drive circuit component layout. As in FIG. 6, the printhead includes a fluidic device 602, energy delivery device 604, nozzle 606, activation devices 608, drive logic 610, and an interconnect layer to electrically couple the drive circuit components. The interconnect layer in the example printhead 700 of FIG. 7 couples the same drive circuit component within the drive logic 610 to both of the activation devices 608. Furthermore, although not shown in FIG. 7, an additional drive logic may also be present in the printhead 700, but is permanently decoupled from any activation device and cannot activate a nozzle.

The present examples may be susceptible to various modifications and alternative forms and have been shown only for illustrative purposes. Furthermore, it is to be understood that the present techniques are not intended to be limited to the particular examples disclosed herein. Indeed, the scope of the appended claims is deemed to include all alternatives, modifications, and equivalents that are apparent to persons skilled in the art to which the disclosed subject matter pertains.

What is claimed is:

1. A method of manufacturing a printhead, comprising:

forming drive circuit components, wherein a layout of the drive circuit components is a standardized layout that is not dependent on a nozzle density of the printhead;

forming a plurality of energy delivery devices and a plurality of activation devices for activating the energy delivery devices;

forming fluidic devices over the drive circuit components, the fluidic devices comprising fluid chambers with fluid ejection nozzles, wherein each of the fluid ejection nozzles is associated with a corresponding energy delivery device; and forming an interconnect layer over the drive circuit components, wherein the interconnect layer configures the drive circuit components, and wherein a layout of the interconnect layer is selected based, at least in part, on the nozzle density of the printhead, wherein forming the interconnect layer comprises coupling each energy delivery device with a pair of activation devices that is addressable to activate a respective fluid ejection nozzle, and wherein the pair of activation devices is driven by an output received from a same one of the drive circuit components.

2. The method of claim 1, wherein forming the interconnect layer comprises leaving some of the drive circuit components permanently uncoupled from all of the activation devices.

3. The method of claim 1, wherein forming the interconnect layer comprises coupling each activation device to a single energy delivery device that is addressable to activate a respective fluid ejection nozzle and leaving half of the plurality of activation devices permanently uncoupled.

4. The method of claim 1, comprising storing an identifier to a memory device of the printhead, the identifier useable by a printer to determine which nozzle addresses of the printhead are valid.

5. The method of claim 1, wherein the layout of the drive circuit components is useable in printheads with different nozzle densities.

6. A printhead, comprising:

a fluidic device coupled to an energy delivery device to cause fluid to be ejected from a nozzle;

a circuit layer comprising drive circuit components, the drive circuit components comprising:

first and second activation devices connected to the energy delivery device, the first and second activation devices to activate the energy delivery device;

first drive logic coupled to the first activation device; and second drive logic coupled to the second activation device; and an interconnect layer to electrically couple the drive circuit components, the interconnect layer to couple a same address selection signal to the first drive logic and the second drive logic, wherein a layout of the interconnect layer is selected based, at least in part, on a nozzle density of the printhead.

7. The printhead of claim 6, wherein the circuit layer includes additional drive circuit components that are associated with unused addresses and are permanently disabled from activating any nozzle on the printhead.

8. The printhead of claim 6, wherein the printhead includes a memory that identifies a nozzle density of the printhead.

9. The printhead of claim 6, wherein the first activation device comprises a first transistor connected to the energy delivery device, and the second activation device comprises a second transistor connected to the energy delivery device, wherein the first drive logic is to control a gate of the first transistor, and the second drive logic is to control a gate of the second transistor.

10. The printhead of claim 9, further comprising an address decoder gate to receive address bits and to generate the address selection signal provided to inputs of the first drive logic and the second drive logic.

11. The printhead of claim 10, wherein the first drive logic and the second drive logic are to further receive a fire signal.

12. The printhead of claim 9, wherein the energy delivery device comprises a resistor or a piezoelectric device connected to and activatable by the first and second transistors.

13. A printhead, comprising:

a fluidic device coupled to an energy delivery device to cause fluid to be ejected from a nozzle;

a circuit layer comprising drive circuit components, the drive circuit components comprising:

first and second activation devices connected to the energy delivery device, the first and second activation devices to activate the energy delivery device; and drive logic coupled to the first and second activation devices; and an interconnect layer to electrically couple the circuit components, the interconnect layer to couple a same drive circuit component to the first and second activation devices, wherein a layout of the interconnect layer is selected based, at least in part, on a nozzle density of the printhead.

14. The printhead of claim 13, wherein some of the drive circuit components are associated with unused addresses and are permanently disabled from activating any nozzle on the printhead.

15. The printhead of claim 13, wherein the printhead includes a memory that identifies a nozzle density of the printhead.

16. The printhead of claim 13, wherein the first activation device comprises a first transistor connected to the energy delivery device, and the second activation device comprises a second transistor connected to the energy delivery device, wherein the drive logic is to control a gate of the first transistor and a gate of the second transistor.

17. The printhead of claim 16, wherein the energy delivery device comprises a resistor or a piezoelectric device connected to and activatable by the first and second transistors.

18. The printhead of claim 16, further comprising an address decoder gate to receive address bits and to generate an address selection signal provided to an input of the drive logic.

19. The printhead of claim 18, wherein the drive logic is to further receive a fire signal.

* * * * *